US012540461B2

(12) United States Patent
Zhang

(10) Patent No.: US 12,540,461 B2
(45) Date of Patent: Feb. 3, 2026

(54) SHOWER

(71) Applicant: Yupeng Zhang, Jieyang (CN)

(72) Inventor: Yupeng Zhang, Jieyang (CN)

( * ) Notice: Subject to any disclaimer, the term of this patent is extended or adjusted under 35 U.S.C. 154(b) by 234 days.

(21) Appl. No.: 18/428,256

(22) Filed: Jan. 31, 2024

(65) Prior Publication Data

US 2024/0240441 A1 Jul. 18, 2024

Related U.S. Application Data

(63) Continuation of application No. PCT/CN2023/126653, filed on Oct. 26, 2023.

(30) Foreign Application Priority Data

Dec. 27, 2022 (CN) ..... 202223528437.1

(51) Int. Cl.
*E03C 1/04* (2006.01)
*E03C 1/046* (2006.01)

(52) U.S. Cl.
CPC ..... *E03C 1/0408* (2013.01); *E03C 1/046* (2013.01)

(58) Field of Classification Search
CPC ..... E03C 1/0408
See application file for complete search history.

(56) References Cited

U.S. PATENT DOCUMENTS

2014/0110434 A1* 4/2014 Ciavarella ..... B05B 11/1087 222/190

FOREIGN PATENT DOCUMENTS

| | | | | |
|---|---|---|---|---|
| CN | 214906283 U | | 11/2021 | |
| CN | 115182418 A | * | 10/2022 | ..... E03C 1/046 |
| CN | 217974611 U | | 12/2022 | |

* cited by examiner

*Primary Examiner* — Christine J Skubinna
(74) *Attorney, Agent, or Firm* — Westbridge IP LLC

(57) ABSTRACT

A shower includes an inlet tank, a first electromagnetic valve, a mixing tank, and a second electromagnetic valve. One end of the inlet tank is provided with an inlet pipe used for communicating with an external water source, the inlet tank, the first electromagnetic valve, the mixing tank, are communicated with the second electromagnetic valve in sequence, the second electromagnetic valve is provided with an outlet pipe; an air pump, one end of which is communicated with the mixing tank, and another end is communicated with the exterior; a liquid pump and a storage tank, the first electromagnetic valve can communicate with or close the inlet tank and the mixing tank, and the second electromagnetic valve can open or close the outlet pipe. The shower gel or the shampoo enter into the mixing tank through two separate pipelines to avoid the mixing of scents.

12 Claims, 7 Drawing Sheets

SHOWER

CROSS-REFERENCE TO RELATED APPLICATIONS

This application is a continuation of International Application No. PCT/CN2023/126653, filed on Oct. 26, 2023, which claims priority to Chinese Patent Application No. 202223528437.1, filed on Dec. 27, 2022. All of the aforementioned applications are incorporated herein by reference in their entireties.

TECHNICAL FIELD

The present disclosure relates to the field of household appliances, and specifically to a shower.

BACKGROUND

People usually use their hands to squeeze the shower gel or shampoo onto their hands or bath cotton to produce foam by rubbing with the skin or hair. The foam generated can make the cleaning effect better, but this bath method is not convenient and not intelligent enough. Therefore, the shower in the market came into being as the times require, but most of the existing shower in the market are low integration, and the internal parts are complex and various, and the foam produced is not exquisite enough.

SUMMARY

Therefore, there is a need to solve the aforementioned issues by providing a highly integrated shower capable of producing fine foam.

The present disclosure provides a shower, comprising: an inlet tank, a first electromagnetic valve, a mixing tank, and a second electromagnetic valve. One end of the inlet tank is provided with an inlet pipe used for communicating with an external water source, the inlet tank, the first electromagnetic valve, the mixing tank, are communicated with the second electromagnetic valve in sequence, and the second electromagnetic valve is provided with an outlet pipe; an air pump, one end of which is communicated with the mixing tank, and another end is communicated with the exterior; and a liquid pump and a liquid storage tank, the liquid storage tank and the liquid pump are communicated with the mixing tank in sequence, the first electromagnetic valve can communicate with or close the inlet tank and the mixing tank, and the second electromagnetic valve can open or close the outlet pipe.

The present disclosure discloses a shower, the second electromagnetic valve serves as the main switch of the liquid path of the shower, and used for controlling the water stoppage and flow through the outlet pipe. The inlet tank is connected to an external water source through the inlet pipe, and connected to the mixing tank via the first electromagnetic valve. The liquid storage tank is used for storing shampoo and shower gel, and is connected to the mixing tank through the liquid pump. When the liquid pump is turned on, the shampoo and shower gel is extracted from the liquid storage tank into the mixing tank to mix with water. By connecting an air pump to the mixing tank, the shampoo or shower gel extracted into the mixing tank can be fully mixed with air and water to produce fine foam, so that the cleaning effect is better. The shampoo and shower gel enter the mixing tank through two independent pipes to avoid odor mixing. The air pump can also pressurize the liquid in the mixing tank, improving the liquid output efficiency of the shower.

By setting an electromagnetic valve, a liquid pump, and an air pump, the shower of the present disclosure thoroughly mixes shower gel or shampoo, air, and water in the mixing tank. The air pump introduces air into the mixing tank, creating fine foam from the shower gel or shampoo, thereby improving cleaning effectiveness and saving on shower gel or shampoo usage. The air pump also pressurizes the mixing tank, enhancing water discharge efficiency. By introducing shampoo and shower gel into the mixing tank through two independent pipes to avoid odor mixing. Compared to the shower apparatus on the market, the shower apparatus of the present disclosure has high integration, reduces too many complex parts, and is easy to assemble.

In some embodiments, the shower further comprises a housing component, the inlet tank, the first electromagnetic valve, the mixing tank, the second electromagnetic valve, the air pump, the liquid pump, and the liquid storage tank are all arranged inside the housing component, the inlet pipe extends outside the housing component, and the outlet pipe extends outside the housing component.

For the above-mentioned shower, it is further limited that by providing the inlet tank, the first electromagnetic valve, the mixing tank, the second electromagnetic valve, the air pump, the liquid pump, and the liquid storage tank within the housing component, which can make the product structure more compact, provide support for each component, and facilitate the inflow and outflow of liquid by the outlet pipe and inlet tank extending outside the housing component.

In some embodiments, the shower further comprises a first pipeline, the inlet tank and the mixing tank are communicated via the first pipeline, the first pipeline is provided with a first valve body that can open or close the first pipeline, at least part of the first valve body extends outside the housing component.

For the above-mentioned shower, it is further limited that that the inlet tank and the mixing tank are connected by two pipelines, and they can be connected through the first electromagnetic valve or the first pipeline. When using shower gel, the first electromagnetic valve is turned off, and water from the inlet tank enters the mixing tank directly through the first pipeline. The shower gel and water can be mixed in the mixing tank, and discharge through the second electromagnetic valve. By setting the first valve body on the first pipeline to control the amount of water mixed. When only water is needed, the first electromagnetic valve is turned on, the water enters into the mixing tank through the first electromagnetic valve, the first electromagnetic valve can control the water flow.

Optionally, the shower further includes a first fixed shell, the mixing tank and the first electromagnetic valve are provided inside the first fixed shell.

By setting the mixing tank and the first electromagnetic valve inside the first fixed shell to provide support for the mixing tank and the first electromagnetic valve and enhances the structural stability of the shower.

Optionally, the shower further includes a second fixed shell, the first valve body is provided inside the second fixed shell.

In some embodiments, the shower further includes a second pipeline and a third pipeline. The air pump is connected to the mixing tank through the second pipeline, while one end of the third pipeline connects to the air pump and another end of the third pipeline communicates with the external environment through an opening of the housing component.

For the above-mentioned shower, it is further limited that the air pump is connected to the external environment through the third pipeline, so that air is extracted from outside. The air pump is connected to the mixing tank through the second pipeline, so that the shampoo or shower gel can be more fully mixed with water, and form fine foam. At the same time, it can also pressurize the mixing tank, and improve the water efficiency.

In some embodiments, the liquid pump includes a first liquid pump and a second liquid pump, and the liquid storage tank includes a first liquid storage tank and a second liquid storage tank. The first liquid pump is connected to the first liquid storage tank, and the second liquid pump is connected to the second liquid storage tank. Both the first liquid pump and second liquid pump are connected to the mixing tank.

For the above-mentioned shower, it is further limited that the liquid storage tank is separated into a first liquid storage tank and a second liquid storage tank, the first liquid storage tank and the second liquid storage tank stores shampoo and shower gel, respectively. The liquid pump is divided into a first liquid pump and a second liquid pump, the first liquid pump is connected to the first liquid storage tank and the second liquid pump is connected to the second liquid storage tank. The first liquid pump and the first liquid storage tank, as well as the second liquid pump and the second liquid storage tank, are two independent pipelines, thus avoiding the mixing of shampoo and shower gel and reducing the cleaning effect, preventing odor mixing, and improving the user experience.

In some embodiments, the shower further comprises a fourth pipeline and a fifth pipeline, the first liquid pump is communicated with the first liquid storage tank via the fourth pipeline, and the second liquid pump is communicated with the second liquid storage tank via the fifth pipeline.

For the above-mentioned shower, it is further limited that by setting the fourth pipeline, the first liquid pump is communicated with the first liquid storage tank, and by setting the fifth pipeline, the second liquid pump is communicated with the second liquid storage tank.

In some embodiments, the shower further comprises a sixth pipeline and a seventh pipeline, the first liquid pump is communicated with the mixing tank via the sixth pipeline, and the second liquid pump is communicated with the mixing tank via the seventh pipeline.

For the above-mentioned shower, it is further limited that by setting the sixth pipeline, the first liquid pump is communicated with the mixing tank, and by setting the seventh pipeline, the second liquid pump is communicated with the mixing tank. The first liquid storage tank, the fourth pipeline, the first liquid pump, and the sixth pipeline are an independent pipeline for shampoo, the second liquid storage tank, the fifth pipeline, the second liquid pump, and the seventh pipeline are an independent pipeline for shower gel.

In some embodiments, the housing component includes a first housing, a bracket, and a second housing, the first housing is arranged on one side of the bracket, and the first housing and the bracket are enclosed to form a first mounting cavity, the second housing is arranged on another side of the bracket, and the second housing and the bracket are enclosed to form a second mounting cavity, the air pump and the liquid pump are arranged on the bracket, the air pump and the liquid pump are all located in the first mounting cavity, the first electromagnetic valve and the second electromagnetic valve are arranged on the bracket and the first electromagnetic valve and the second electromagnetic valve are located on the second mounting cavity.

For the above-mentioned shower, it is further limited that by setting the bracket, the first electromagnetic valve, the second electromagnetic valve, the air pump, the liquid pump, the inlet tank, and the mixing tank can be respectively arranged on two sides of the bracket. Thereby saving space and making the structure of the shower more compact. By setting the first and second housings on two sides of the bracket, so as to avoid external environmental pollution and damage to various components, improve the durability and reliability of the shower, and also make the shower more beautiful.

In some embodiments, the housing component further includes a third housing and a first cover, the third housing is arranged at one end of the bracket, one end of the third housing opposite to the first cover is provided with a magnetic component, and another end of the third housing opposite to the first cover is provided with a corresponding snap-fit structure, the third housing and the first cover are detachably connected, the third housing and the first cover are enclosed to form a second mounting cavity, and the liquid storage tank is located in this second mounting cavity.

For the above-mentioned shower, it is further limited that the third housing and first cover is the first solution. By using the third housing and the first cover to house the first and second liquid storage tanks, the structure of the shower becomes more compact. The first cover and the third housing are removably connected through magnetic components and snap-fit structures, facilitating the replenishment of shampoo and shower gel in the first and second liquid storage tanks.

In some embodiments, the housing component further includes a third housing and a first cover, the third housing is arranged at one end of the bracket, one end of the third housing opposite to the first cover is provided with a magnetic component, and another end of the third housing opposite to the first cover is provided with a corresponding snap-fit structure, the third housing and the first cover are detachably connected, the third housing and the first cover are enclosed to form a second mounting cavity, the third housing is provided with at least two support plates, the support plate is located in the second mounting cavity, the third housing is further provided with a plurality of limit holes, the snap-fit structure formed on the support plate is adapted to the plurality of limit holes.

For the above-mentioned shower, it is further limited that the structure of the third housing and the first cover are another solution. The second mounting chamber in the third housing is used to directly place bottles of shower gel and shampoo without pouring them into the first and second liquid storage tanks. The overall length of the third housing and the first cover of this solution is larger than that of the first solution, and it can be used for bottles of various lengths of shower gel and shampoo. By setting a support plate in the second mounting chamber for placing the bottles, and the third housing is provided with multiple limit holes at different heights, allowing the support plate to be placed at different heights, thereby adapting to various lengths of shower gel and shampoo bottles.

In some embodiments, the shower further comprises a control component and a panel, the control component is arranged on the second housing, and the panel is arranged on the second housing, the panel and the second housing are enclosed to form a third mounting cavity, the control component is located in the third mounting cavity, the control component includes a control element, an audio element, and a circuit board, the control element and the audio element are electrically connected to the circuit board, the circuit board is also electrically connected to the first electromagnetic valve, the second electromagnetic valve, the air pump, and the liquid pump.

For the above-mentioned shower, it is further limited that the control component is placed in the third mounting cavity formed by the second housing and the panel. The control component can be used to control the switch of the shower, extracting shower gel, or shampoo, or water, etc. The audio element can achieve voice control to produce bubbles or output water.

In some embodiments, the shower further comprises a power component, provided in the housing component.

For the above-mentioned shower, it is further limited that the power component supplies power to the shower, allowing for more flexibility in placement. Optionally, the power component can be a rechargeable battery.

DETAILED DESCRIPTION OF THE EMBODIMENTS

Figure 1:
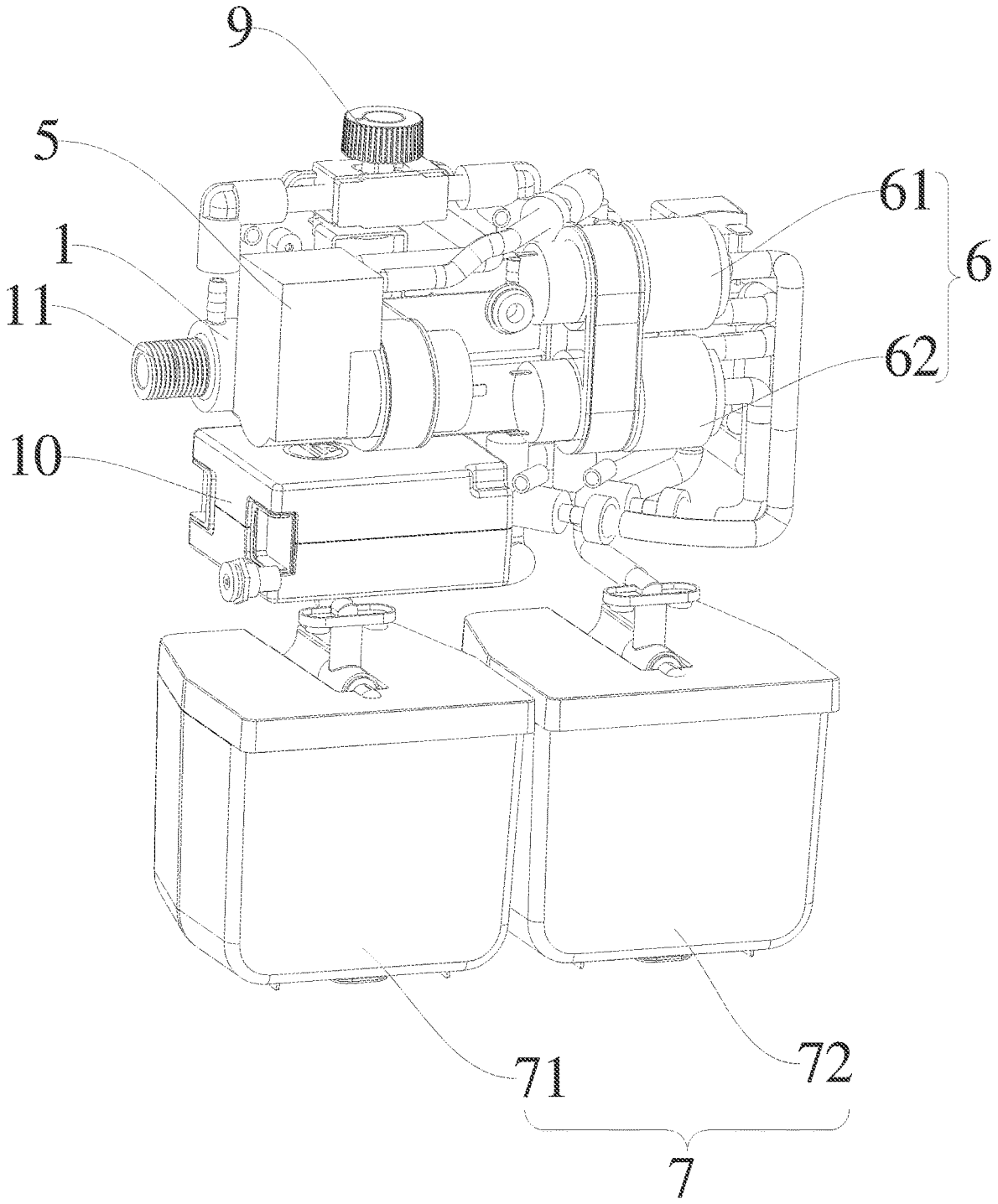
FIG. 1 is an internal structure view of a shower according to the present disclosure.

In order to better understand the above objectives, features, and advantages of the present disclosure, a further detailed description of the present disclosure will be provided below in conjunction with the drawings and specific embodiments. It should be noted that, without conflict, the embodiments of the present disclosure and the features in the embodiments can be combined with each other.

Many specific details are elaborated in the following description to facilitate a full understanding of the present disclosure. However, the present disclosure can also be implemented in other ways different from those described herein. Therefore, the scope of protection of the present disclosure is not limited by the specific embodiments disclosed below.

The following describes some embodiments of the shower of the present disclosure with reference to the drawings.

As shown in FIGS. 1 to 4, the present disclosure provides a shower comprising: an inlet tank 1, a first electromagnetic valve 2, a mixing tank 3, and a second electromagnetic valve 4. One end of the inlet tank 1 is provided with an inlet pipe 11 used for communicating with an external water source, the inlet tank 1, the first electromagnetic valve 2, the mixing tank 3, are communicated with the second electromagnetic valve 4 in sequence, and the second electromagnetic valve 4 is provided with an outlet pipe 41; an air pump 5, one end of which is communicated with the mixing tank 3, and another end is communicated with the exterior; and a liquid pump 6 and a liquid storage tank 7, the liquid storage tank 7 and the liquid pump 6 are communicated with the mixing tank 3 in sequence, the first electromagnetic valve 2 can communicate with or close the inlet tank 1 and the mixing tank 3, and the second electromagnetic valve 4 can open or close the outlet pipe 41.

The present disclosure discloses a shower, the second electromagnetic valve 4 serves as the main switch of the fluid path of the shower, and used for controlling the water stoppage and flow through the outlet pipe 41. The inlet tank 1 is connected to an external water source through the inlet pipe 11. The inlet tank 1 is connected to the mixing tank 3 through the first electromagnetic valve 2. The liquid storage tank 7 is used for storing shampoo and shower gel. The liquid storage tank 7 is connected to the mixing tank 3 through the liquid pump 6. When the liquid ump 6 is turned on, the shampoo and shower gel is extracted from the liquid storage tank 7 into the mixing tank 3 to mix with water. By connecting an air pump to the mixing tank, the shampoo or shower gel extracted into the mixing tank can be fully mixed with air and water to produce fine foam, so that the cleaning effect is better. The shampoo and shower gel enter the mixing tank through two independent pipes to avoid odor mixing. The air pump can also pressurize the liquid in the mixing tank, improving the liquid output efficiency of the shower.

By setting an electromagnetic valve, a liquid pump 6, and an air pump 5, the shower of the present disclosure thoroughly mixes shower gel or shampoo, air, and water in the mixing tank 3. The air pump 5 introduces air into the mixing tank 3, creating fine foam from the shower gel or shampoo, thereby improving cleaning effectiveness and saving on shower gel or shampoo usage. The air pump 5 also pressurizes the mixing tank 3, enhancing water discharge efficiency. By introducing shampoo and shower gel into the mixing tank 3 through two independent pipes to avoid odor mixing. Compared to the shower apparatus on the market, the shower apparatus of the present disclosure has high integration, reduces too many complex parts, and is easy to assemble.

Figure 2:
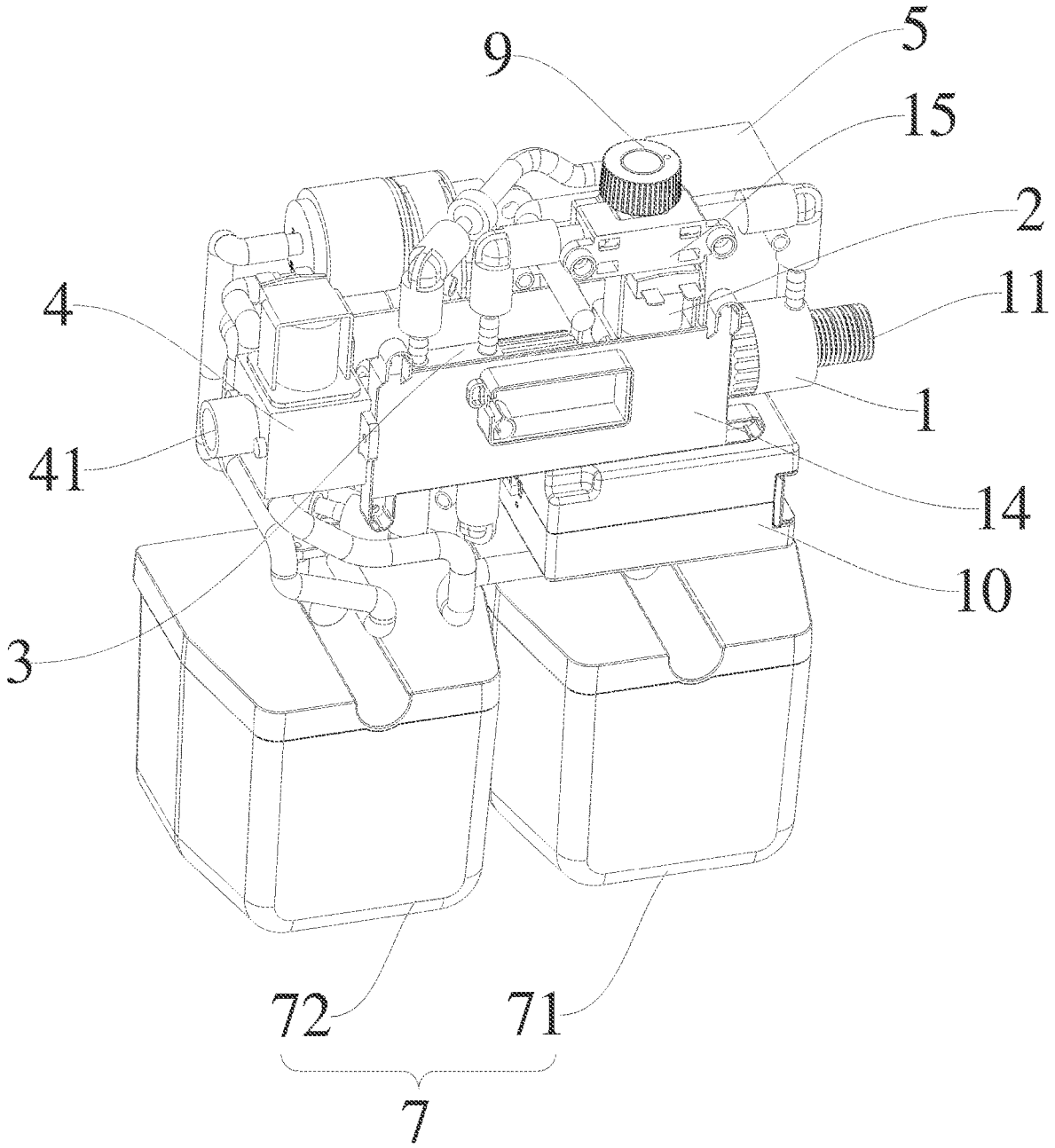
FIG. 2 is an internal structure rear view of the shower according to the present disclosure.
Figure 5:
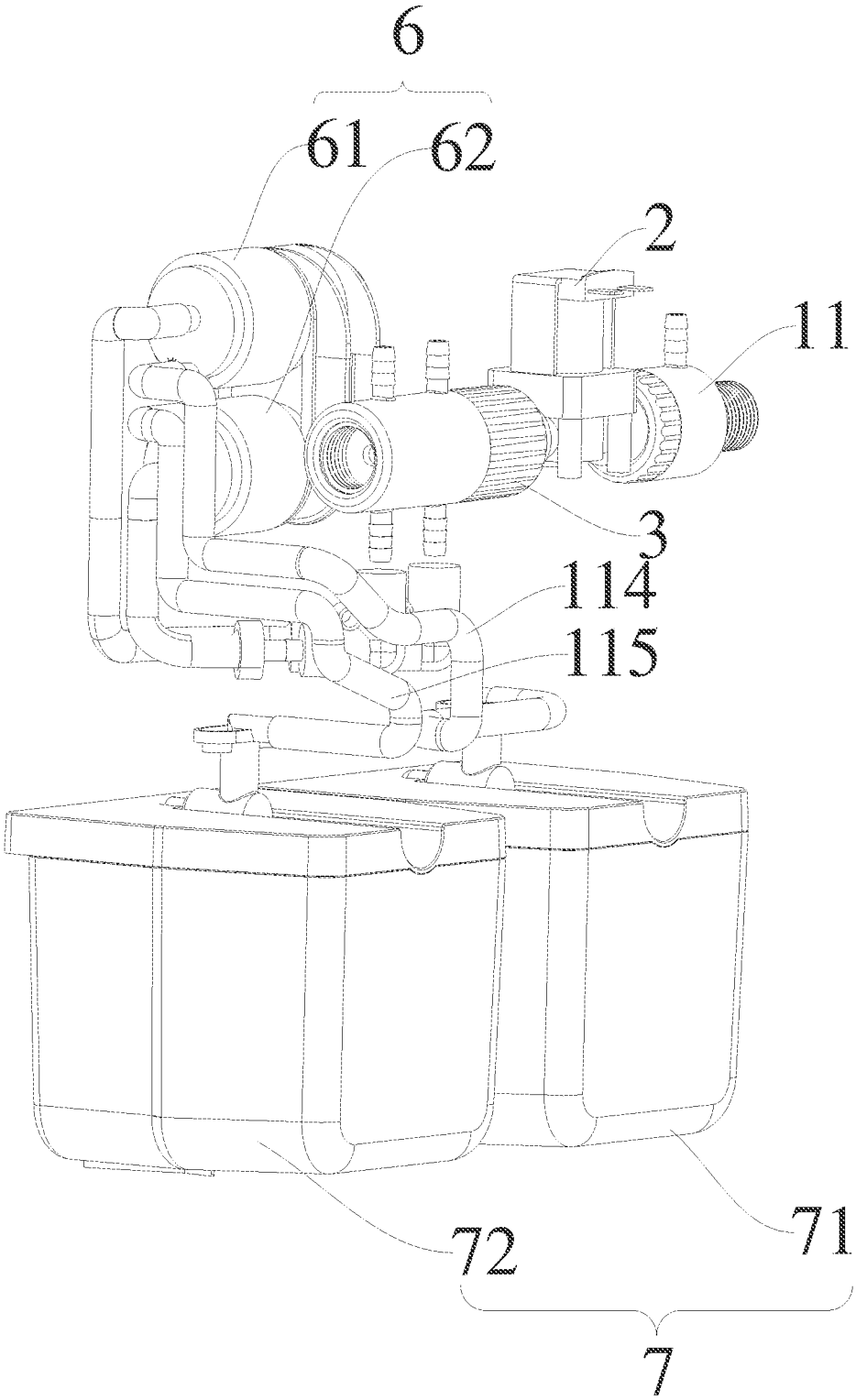
FIG. 5 is a structure schematic of a liquid pump, a liquid storage tank, and their pipelines in the shower according to the present disclosure.

As shown in FIGS. 1, 2, and 5, in this embodiment, the shower further comprises a housing component 8, the inlet tank 1, the first electromagnetic valve 2, the mixing tank 3, the second electromagnetic valve 4, the air pump 5, the liquid pump 6, and the liquid storage tank 7 are all arranged inside the housing component 8. The inlet pipe 11 extends outside the housing component 8, and the outlet pipe 41 extends outside the housing component 8.

For the above-mentioned shower, it is further limited that by providing the inlet tank 1, the first electromagnetic valve 2, mixing tank 3, the second electromagnetic valve 4, the air pump 5, the liquid pump 6, and the liquid storage tank 7 inside the housing component 8, which can make the product structure more compact, provide support for each component, and facilitate the inflow and outflow of the liquid by the outlet pipe 41 and inlet pipe 11 extending outside the housing component 8.

Figure 3:
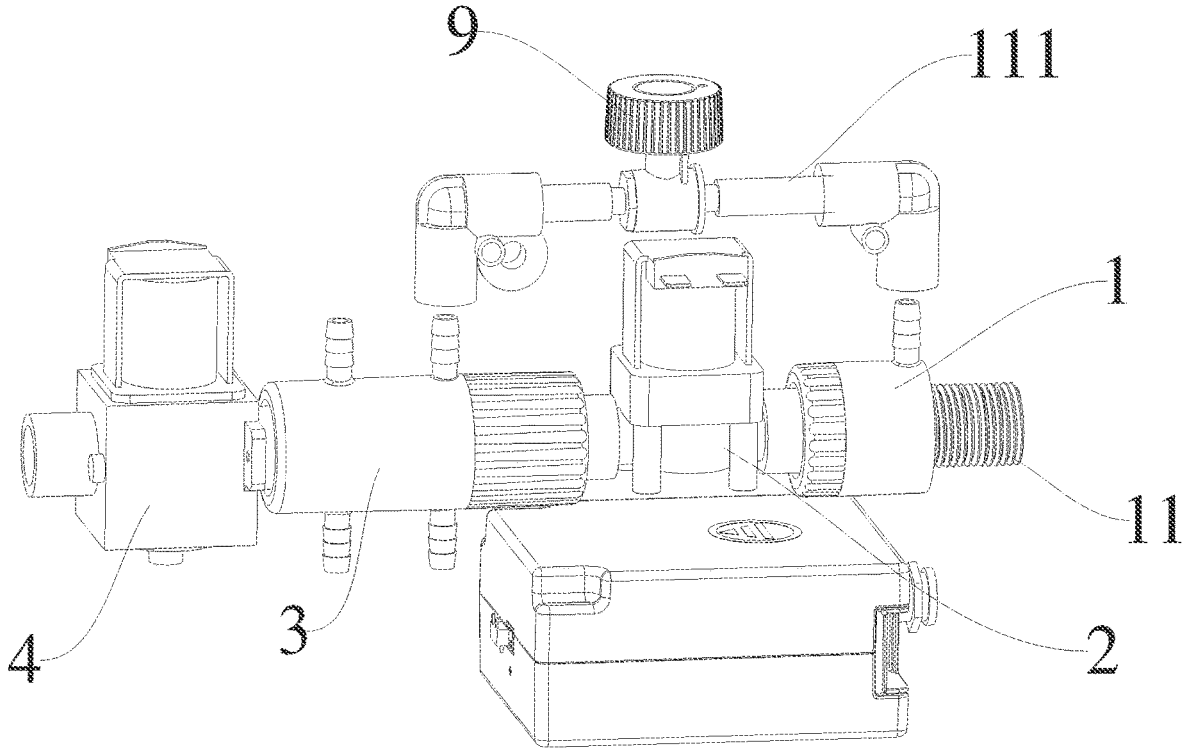
FIG. 3 is a structure schematic of a first pipeline and a first valve body in the shower according to the present disclosure.

As shown in FIGS. 2, 3, and 5, in this embodiment, the shower further comprises a first pipeline 111, the inlet tank 1 and the mixing tank 3 are communicated by the first pipeline 111, the first pipeline 111 is provided with a first valve body 9. The first valve body 9 can open or close the first pipeline 111, and at least part of the first valve body 9 extends outside the housing component 8.

For the above-mentioned shower, it is further limited that the inlet tank 1 and the mixing tank 3 are connected by two pipelines. The inlet tank 1 and the mixing tank 3 can be connected through the first electromagnetic valve 2 or the first pipeline 111. When shower gel is needed, turn off the first electromagnetic valve 2, and the water in the inlet tank 1 enters the mixing tank 3 directly through the first pipeline 111. The shower gel and water can be mixed in the mixing tank 3 and discharge through the second electromagnetic valve 4. By setting the first valve body 9 on the first pipeline 111 to control the amount of water mixed. When only water is needed, turn on the first electromagnetic valve 2, and the water enters into the mixing tank 3 through the first electromagnetic valve 2, which can control the water flow.

Optionally, the shower further includes a first fixed shell 14. The mixing tank 3 and the first electromagnetic valve 2 are provided inside the first fixed shell 14.

By setting the mixing tank 3 and the first electromagnetic valve 2 inside the first fixed shell 14, support is provided to the mixing tank and the first electromagnetic valve, enhance the structural stability of the shower.

Optionally, the shower further includes a second fixed shell 15. The first valve body 9 is set inside the second fixed shell 15.

As shown in FIGS. 3 and 5, in this embodiment, the shower further includes a second pipeline 112 and a third pipeline 113. The air pump 5 is connected to the mixing tank 3 through the second pipeline 112. While one end of the third pipeline 113 connects to the air pump 5, and another end of the third pipeline 113 communicates with the external environment through an opening of the housing component 8.

For the above-mentioned shower, it is further limited that the air pump 5 is connected to the external environment through the third pipeline 113, so that air is extracted from outside. The air pump 5 is connected to the mixing tank 3 through the second pipeline 112, so that the shampoo or shower gel can be more fully mixed with water, and form fine foam. At the same time, it can also pressurize the mixing tank 3, and improve the water efficiency.

Figure 4:
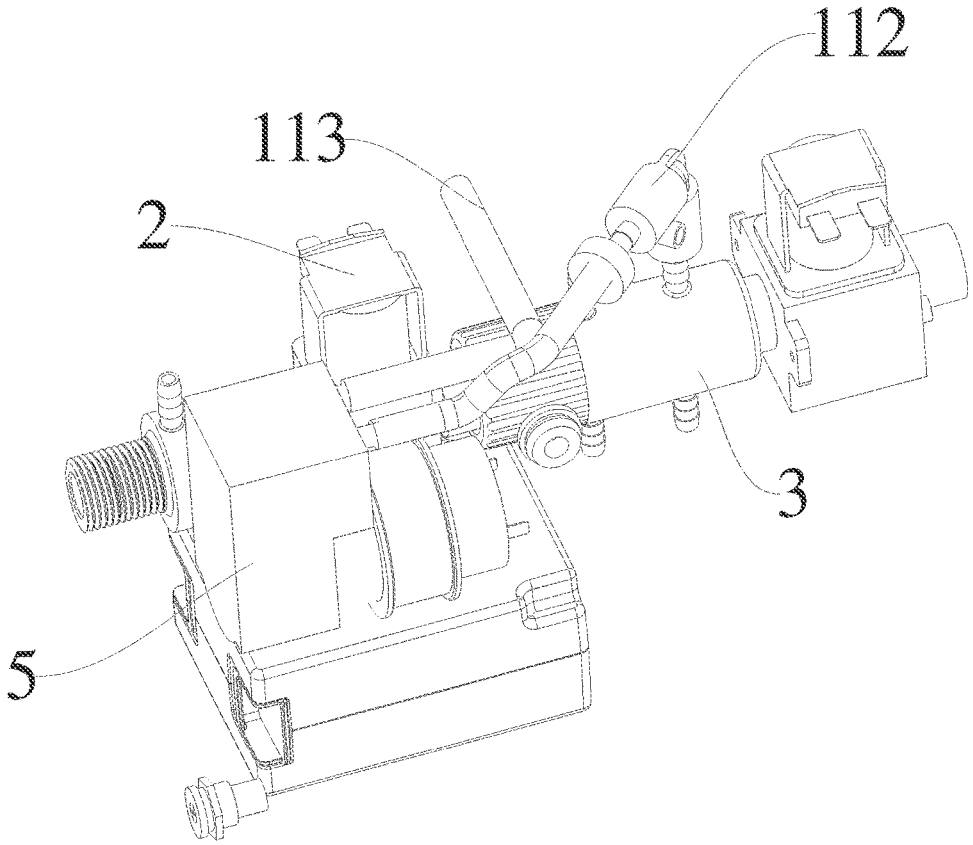
FIG. 4 is a structure schematic of an air pump, a second pipeline, and a third pipeline in the shower according to the present disclosure.

As shown in FIGS. 4 and 5, in this embodiment, the liquid pump 6 includes a first liquid pump 61 and a second liquid pump 62. The liquid storage tank 7 includes a first liquid storage tank 71 and a second liquid storage tank 72. The first liquid pump 61 is connected to the first liquid storage tank 71, and the second liquid pump 62 is connected to the second liquid storage tank 72. Both the first liquid pump 61 and the second liquid pump 62 are connected to the mixing tank 3.

For the above-mentioned shower, it is further limited that the liquid storage tank 7 is divided into a first liquid storage tank 71 and a second liquid storage tank 72. The first liquid storage tank 71 and the second liquid storage tank 72 are used for storing shampoo and shower gel, respectively. The liquid pump 6 is divided into a first liquid pump 61 and a second liquid pump 62. The first liquid pump 61 is connected to the first liquid storage tank 71, and the second liquid pump 62 is connected to the second liquid storage tank 72. The first liquid pump 61 and the first liquid storage tank 71, as well as the second liquid pump 62 and the second liquid storage tank 72 are two independent pipelines, thus avoiding the mixing of shampoo and shower gel, and reducing the cleaning effect, preventing odor mixing, and improving the user experience.

As shown in FIGS. 4 and 5, in this embodiment, the shower further includes a fourth pipeline 114 and a fifth pipeline 115. The first liquid pump 61 is communicated with the first liquid storage tank 71 through the fourth pipeline 114, and the second liquid pump 62 is communicated with the second liquid storage tank 72 through the fifth pipeline 115.

For the above-mentioned shower, it is further limited that by setting the fourth pipeline 114, the first liquid pump 61 is communicated with the first liquid storage tank 71, and by setting the fifth pipeline 115, the second liquid pump 62 is communicated with the second liquid storage tank 72.

As shown in FIGS. 4 and 5, in this embodiment, the shower further includes a sixth pipeline and a seventh pipeline. The first liquid pump 61 is communicated with the mixing tank 3 through the sixth pipeline, and the second liquid pump 62 is communicated with the mixing tank 3 through the seventh pipeline.

For the above-mentioned shower, it is further limited that by setting the sixth pipeline, the first liquid pump 61 is communicated with the mixing tank 3, and by setting the seventh pipeline, the second liquid pump 62 is communicated with the mixing tank 3. The first liquid storage tank 71, the fourth pipeline 114, the first liquid pump 61, and the sixth pipeline are an independent pipeline for shampoo, the second liquid storage tank 72, the fifth pipeline 115, the second liquid pump 62, and the seventh pipeline are an independent pipeline for shower gel.

As shown in FIGS. 1, 2, 5, and 7, in this embodiment, the housing component 8 includes a first housing 81, a bracket 82, and a second housing 83. The first housing 81 is arranged on one side of the bracket 82, and the first housing 81 and the bracket 82 are enclosed to form the first mounting cavity 801. The second housing 83 is arranged on another side of the bracket 82, and the second housing 83 and the bracket 82 are enclosed to form the second mounting cavity 802. The air pump 5 and the liquid pump 6 are arranged on the bracket 82, and the air pump 5 and the liquid pump 6 are all located in the first mounting cavity 801. The first electromagnetic valve 2 and the second electromagnetic valve 4 are arranged on the bracket 82, and the first electromagnetic valve 2 and the second electromagnetic valve 4 are located on the second mounting cavity 802.

For the above-mentioned shower, it is further limited that by setting the bracket 82, the first electromagnetic valve 2, the second electromagnetic valve 4, the air pump 5, the liquid pump 6, the inlet tank 1, and the mixing tank 3 can be respectively arranged on two sides of the bracket 82, thereby saving space and making the structure of the shower more compact. By setting the first housing 81 and the second housing 83 on two sides of the bracket 82, so as to avoid external environmental pollution and damage to various components, improve the durability and reliability of the shower, and also make the shower more beautiful.

As shown in FIG. 5, in this embodiment, the housing component 8 further includes a third housing 84 and a first cover 85. The third housing 84 is arranged at one end of the bracket 82, and one end of the third housing 84 opposite to the first cover 85 is provided with a magnetic component. Another end of the third housing 84 opposite to the first cover 85 is provided with a corresponding snap-fit structure, the third housing 84 and the first cover 85 are detachably connected. The third housing 84 and the first cover 85 are enclosed to form a second mounting cavity, and the liquid storage tank 7 is located in the second mounting cavity.

For the above-mentioned shower, it is further limited that the third housing 84 and the first cover 85 is the first solution. By using the third housing 84 and the first cover 85 for placing the first liquid storage tank 71 and the second liquid storage tank 72, the structure of the shower becomes more compact. The first cover 85 and the third housing 84 are removably connected through magnetic components and snap-fit structures, thus facilitating the replenishment of shampoo and shower gel into the first liquid storage tank 71 and the second liquid storage tank 72.

Figure 6:
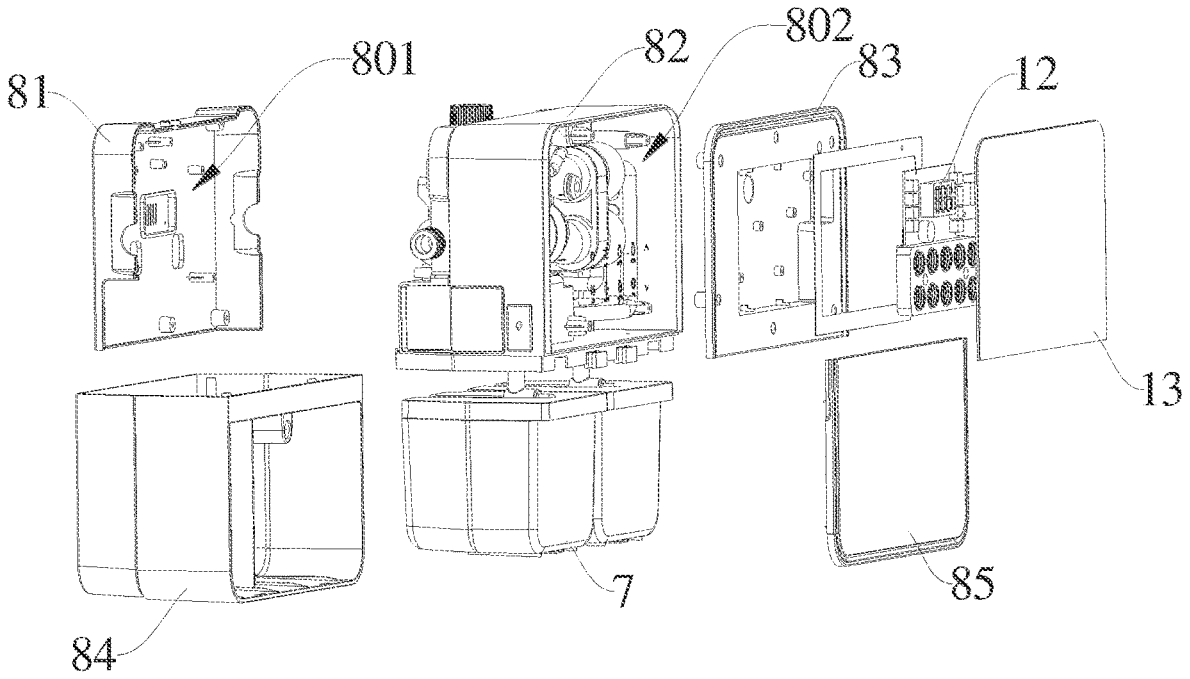
FIG. 6 is an exploded schematic of the shower according to the present disclosure.
Figure 7:
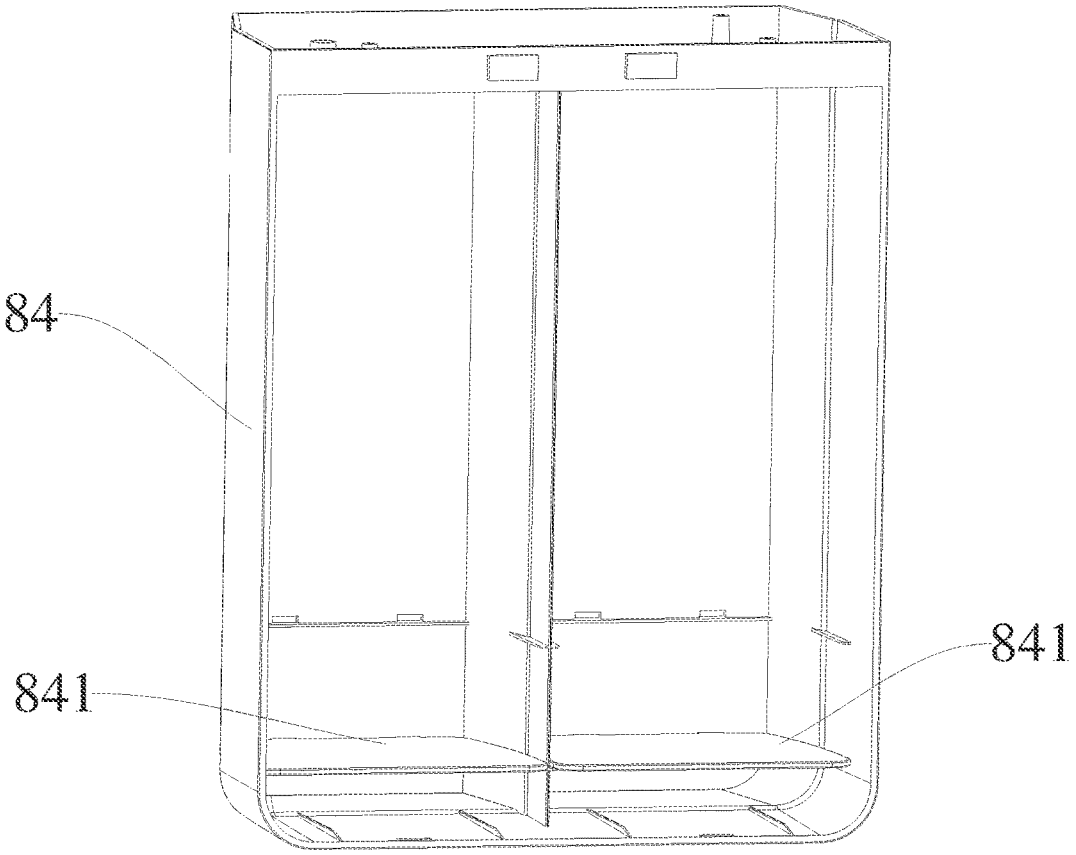
FIG. 7 is a structure schematic of a third housing in the shower according to the present disclosure.

As shown in FIGS. 5 and 6, in some embodiments, the housing component 8 further includes a third housing 84 and a first cover 85, the third housing 84 is arranged at one end of the bracket 82, one end of the third housing 84 opposite to the first cover 85 is provided with a magnetic component, and another end of the third housing 84 opposite to the first cover 85 is provided with a corresponding snap-fit structure, the third housing 84 and the first cover 85 are detachably connected, the third housing 84 and the first cover 85 are enclosed to form a second mounting cavity, the third housing 84 is provided with at least two support plates 841, the support plate 841 is located in the second mounting cavity, the third housing 84 is further provided with a plurality of limit holes, the snap-fit structure formed on the support plate 841 is adapted to the plurality of limit holes.

For the above-mentioned shower, it is further limited that the structure of the third housing 84 and the first cover 85 are another solution. The second mounting chamber in the third housing 84 is used to directly place bottles of shower gel and shampoo without pouring them into the first liquid storage tank 71 and second liquid storage tank 72. The overall length of the third housing 84 and the first cover 85 of this solution is larger than that of the first solution, and it can be used for bottles of various lengths of shower gel and shampoo. By setting a support plate 841 in the second mounting chamber for placing the bottles, and the third housing 84 is provided with multiple limit holes at different heights, allowing the support plate 841 to be placed at different heights, thereby adapting to various lengths of shower gel and shampoo bottles.

Figure 8:
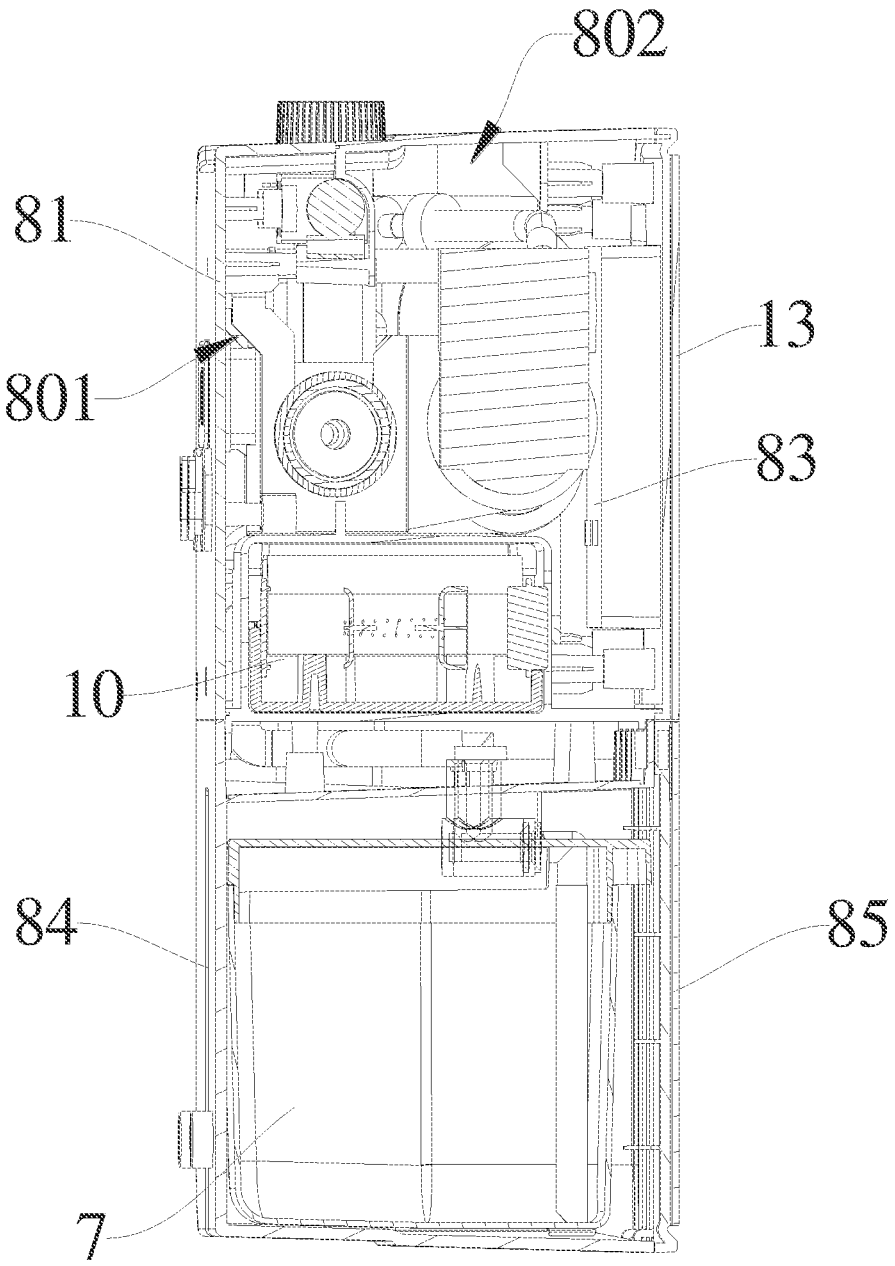
FIG. 8 is a cross-sectional view of the shower according to the present disclosure.
Figure 9:
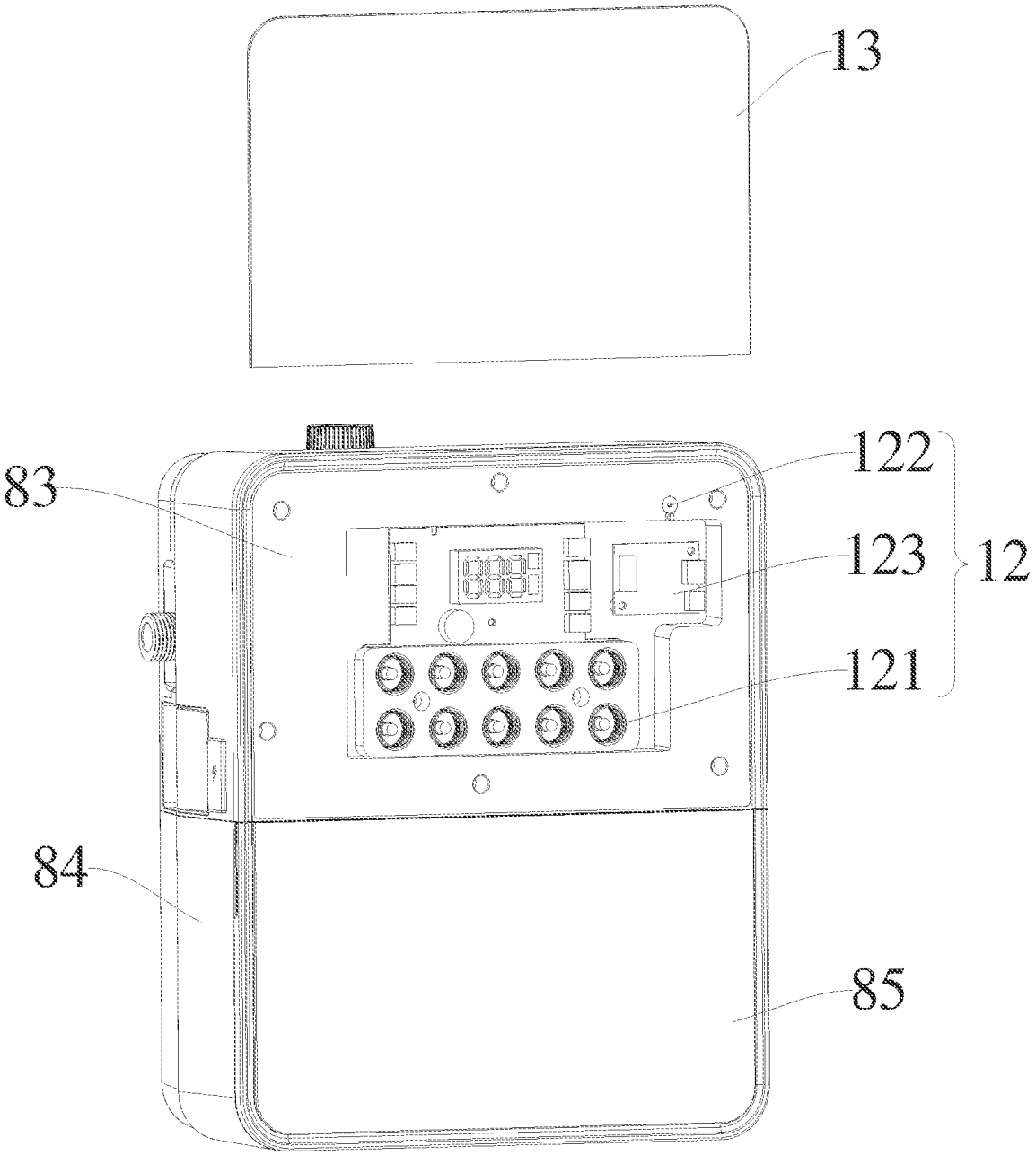
FIG. 9 is a structure schematic of a control component in the shower according to the present disclosure.

As shown in FIGS. 1, 2, and 8, in some embodiments, the shower further comprises a control component 12 and a panel 13, the control component 12 is arranged on the second housing 84, and the panel 13 is arranged on the second housing 83, the panel 13 and the second housing 83 are enclosed to form a third mounting cavity, the control component 12 is located in the third mounting cavity, the control component 12 includes a control element 121, an audio element 122, and a circuit board 123, the control element 121 and the audio element 122 are electrically connected to the circuit board 123, the circuit board 123 is also electrically connected to the first electromagnetic valve 2, the second electromagnetic valve 4, the air pump 5, and the liquid pump 6.

For the above-mentioned shower, it is further limited that the control component 12 is placed in the third mounting cavity formed by the second housing 83 and the panel 13. The control component 121 can be used to control the switch of the shower, extracting shower gel, or shampoo, or water, etc. The audio element 122 can achieve voice control to produce bubbles or output water.

As shown in FIGS. 1 and 5, in some embodiments, the shower further comprises a power component 10, provided in the housing component 8.

For the above-mentioned shower, it is further limited that the power component 10 supplies power to the shower, allowing for more flexibility in placement. Optionally, the power component 10 can be a rechargeable battery.

The embodiments described above are just several embodiments of the present disclosure, described in detail and specific terms, but they should not be construed as limiting the scope of patent of the present disclosure. It should be noted that for those skilled in the art, various modifications and improvements can be made without departing from the concept of the present disclosure, and these all fall within the protection scope of the present disclosure. Therefore, the protection scope of the present disclosure should be determined by the attached claims.

What is claimed is:

1. A shower, comprising:

an inlet tank, a first electromagnetic valve, a mixing tank, and a second electromagnetic valve, wherein one end of the inlet tank is provided with an inlet pipe used for communicating with an external water source, the inlet tank, the first electromagnetic valve and the mixing tank are communicated with the second electromagnetic valve in sequence, and the second electromagnetic valve is provided with an outlet pipe;

an air pump, wherein one end of the air pump is communicated with the mixing tank, and another end of the air pump is communicated with the exterior; and a liquid pump and a liquid storage tank communicated with the mixing tank in sequence, wherein the first electromagnetic valve is capable of communicating with or closing the inlet tank and the mixing tank, and the second electromagnetic valve is capable of opening or closing the outlet pipe.

2. The shower according to claim 1, further comprising a housing component, wherein the inlet tank, the first electromagnetic valve, the mixing tank, the second electromagnetic valve, the air pump, the liquid pump, and the liquid storage tank are all arranged inside the housing component, the inlet pipe extends outside the housing component, the outlet pipe extends outside the housing component.

3. The shower according to claim 2, further comprising a first pipeline, wherein the inlet tank and the mixing tank are communicated via the first pipeline, the first pipeline is provided with a first valve body that is capable of opening or closing the first pipeline, at least a part of the first valve body extends outside the housing component.

4. The shower according to claim 2, further comprising a second pipeline and a third pipeline, wherein the air pump and the mixing tank are communicated via the second pipeline, one end of the third pipeline is connected to the air pump, and another end of the third pipeline is communicated with the exterior through an opening of the housing component.

5. The shower according to claim 1, wherein the liquid pump comprises a first liquid pump and a second liquid pump, and the liquid storage tank comprises a first liquid storage tank and a second liquid storage tank, the first liquid pump is communicated with the first liquid storage tank, the second liquid pump is communicated with the second liquid storage tank, and the first liquid pump and the second liquid pump are communicated with the mixing tank.

6. The shower according to claim 5, further comprising a fourth pipeline and a fifth pipeline, wherein the first liquid pump is communicated with the first liquid storage tank via the fourth pipeline, and the second liquid pump is communicated with the second liquid storage tank via the fifth pipeline.

7. The shower according to claim 5, further comprising a sixth pipeline and a seventh pipeline, wherein the first liquid pump is communicated with the mixing tank via the sixth pipeline, and the second liquid pump is communicated with the mixing tank via the seventh pipeline.

8. The shower according to claim 3, wherein the housing component comprises a first housing, a bracket, and a second housing, the first housing is arranged on one side of the bracket, the first housing and the bracket are enclosed to form a first mounting cavity, the second housing is arranged on another side of the bracket, the second housing and the bracket are enclosed to form a second mounting cavity, the air pump and the liquid pump are arranged on the bracket, the air pump and the liquid pump are all located in the first mounting cavity, the first electromagnetic valve and the second electromagnetic valve are arranged on the bracket, and the first electromagnetic valve and the second electromagnetic valve are located on the second mounting cavity.

9. The shower according to claim 8, wherein the housing component further comprises a third housing and a first cover, the third housing is arranged at one end of the bracket, one end of the third housing opposite to the first cover is provided with a magnetic component, another end of the third housing opposite to the first cover is provided with a corresponding snap-fit structure, the third housing and the first cover are detachably connected, the third housing and the first cover are enclosed to form a second mounting cavity, and the storage tank is located in this second mounting cavity.

10. The shower according to claim 8, wherein the housing component further comprises a third housing and a first cover, the third housing is arranged at one end of the bracket, one end of the third housing opposite to the first cover is provided with a magnetic component, and another end of the third housing opposite to the first cover is provided with a corresponding snap-fit structure, the third housing and the first cover are detachably connected, the third housing and the first cover are enclosed to form a second mounting cavity, the third housing is provided with at least two support plates, the support plate is located in the second mounting cavity, the third housing is further provided with a plurality of limit holes, the snap-fit structure formed on the support plate is adapted to the plurality of limit holes.

11. The shower according to claim 8, further comprising a control component and a panel, the control component is arranged on the second housing, the panel is arranged on the second housing, the panel and the second housing are enclosed to form a third mounting cavity, the control component is located in the third mounting cavity, the control component comprises a control element, an audio element, and a circuit board, the control element and the audio element are electrically connected to the circuit board, the circuit board is also electrically connected to the first electromagnetic valve, the second electromagnetic valve, the air pump, and the liquid pump.

12. The shower according to claim 8, further comprising a power component provided in the housing component.

* * * * *